US007706719B2

(12) United States Patent
Kiyama

(10) Patent No.: US 7,706,719 B2
(45) Date of Patent: Apr. 27, 2010

(54) IMAGE FORMING APPARATUS WITH AN OPENABLE SECTION AT AN UPPER FACE SIDE OR A FRONT FACE SIDE

(75) Inventor: Tadashi Kiyama, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 506 days.

(21) Appl. No.: 11/488,603

(22) Filed: Jul. 19, 2006

(65) Prior Publication Data

US 2007/0147880 A1 Jun. 28, 2007

(30) Foreign Application Priority Data

Dec. 22, 2005 (JP) ..... 2005-369478

(51) Int. Cl.
*G03G 15/00* (2006.01)
*G03G 21/00* (2006.01)

(52) U.S. Cl. ..... 399/110; 399/107; 399/124

(58) Field of Classification Search ..... 399/107, 399/110, 119, 121, 124, 125, 227
See application file for complete search history.

(56) References Cited

U.S. PATENT DOCUMENTS 5,438,391 A * 8/1995 Maekawa et al. ..... 399/125
5,612,771 A 3/1997 Yamamoto et al.
5,887,228 A * 3/1999 Motohashi et al. ..... 399/121 X
6,418,296 B1 * 7/2002 Aizawa et al. ..... 399/227 X
6,546,228 B2 * 4/2003 Motohashi et al. ..... 399/124 X
2004/0208670 A1 * 10/2004 Abe ..... 399/110
2005/0207790 A1 9/2005 Yamada et al.

FOREIGN PATENT DOCUMENTS

JP 2000-194203 A 7/2000
JP 2000-298382 A 10/2000
JP 2004-037916 A 2/2004
JP 2004-198551 A 7/2004

OTHER PUBLICATIONS

Chinese Office Action Dated Jun. 13, 2008.

* cited by examiner

*Primary Examiner*—Sandra L Brase
(74) *Attorney, Agent, or Firm*—Sughrue Mion, PLLC

(57) ABSTRACT

An image forming apparatus includes: an image forming apparatus body, a photosensitive member, an intermediate transfer belt, and a developing device placed on a side opposite to the intermediate transfer belt across the photosensitive member and provided with a detachable toner cartridge. The intermediate transfer belt is disposed such that a distance between ends in a height direction is longer than a distance between ends in an anteroposterior direction. At least a part of the photosensitive member is placed between the anteroposterior ends of the intermediate transfer belt. The image forming apparatus body includes an openable section at an upper face side or a front face side thereof to allow the toner cartridge to be attached and detached therethrough and to allow a jam to be fixed therethrough.

9 Claims, 4 Drawing Sheets

IMAGE FORMING APPARATUS WITH AN OPENABLE SECTION AT AN UPPER FACE SIDE OR A FRONT FACE SIDE

BACKGROUND OF THE INVENTION

1. Field of the Invention

The present invention relates to an image forming apparatus such as a printer, a copier, or a facsimile apparatus.

2. Description of the Related Art

In an image forming apparatus of this kind, a photosensitive member, a developing device, an intermediate transfer belt, and the like are disposed in an image forming apparatus body. It is known that a device of the rotary type is used as the developing device. Such a developing device has a toner cartridge which houses a toner, and the toner cartridge is detachably disposed.

In any image forming apparatus of the conventional art, however, the device is not laid out so that all user operations such as attachment and detachment of a toner cartridge, a jam process, and replenishment of sheets can be performed only from an upper face side or a front face side. Therefore, such an apparatus has a problem in that the operability is poor.

SUMMARY OF THE INVENTION

The invention provides an image forming apparatus in which at least attachment and detachment of a toner cartridge and a fix of a jam can be performed from an upper face side or a front face side, thereby improving the operability.

According to an aspect of the invention, an image forming apparatus includes: an image forming apparatus body; a photosensitive member disposed in the image forming apparatus body; an intermediate transfer belt disposed in the image forming apparatus body, the intermediate transfer belt onto which a toner image on the photosensitive member is to be transferred; and a developing device disposed in the image forming apparatus body, the developing device placed on a side opposite to the intermediate transfer belt across the photosensitive member and provided with a detachable toner cartridge. The intermediate transfer belt is disposed such that a distance between ends in a height direction of the image forming apparatus body is longer than a distance between ends in an anteroposterior direction of the image forming apparatus body. At least a part of the photosensitive member is placed between the anteroposterior ends of the intermediate transfer belt. The image forming apparatus body includes an openable section at an upper face side or a front face side thereof to allow the toner cartridge to be attached and detached therethrough and to allow a jam to be fixed therethrough.

BRIEF DESCRIPTION OF THE DRAWINGS

Embodiment may be described in detail with reference to the accompanying drawings, in which:

FIGS. 2A and 2B show a method of replacing (attaching or detaching) an image forming unit in the image forming apparatus of the embodiment of the invention, wherein FIG. 2A is a side view showing a state where first and second openable and closable covers are opened, and FIG. 2B is a side view showing a state where an image forming unit is detached;

FIGS. 3A and 3B show a method of replacing (attaching or detaching) toner cartridges in the image forming apparatus of the embodiment of the invention, wherein FIG. 3A is a side view showing a state where a rotary developing device is rotated, FIG. 3B is a side view showing a state where a third openable and closable cover is opened, FIGS. 4A and 4B show a method of processing a jam in the image forming apparatus of the embodiment of the invention, wherein FIG. 4A is a side view showing a state where the first openable and closable cover is opened, and FIG. 4B is a side view showing a state where a recording medium causing a jam is to be removed.

DETAILED DESCRIPTION OF THE INVENTION

Next, an embodiment of the invention will be described with reference to the accompanying drawings.

Figure 1:
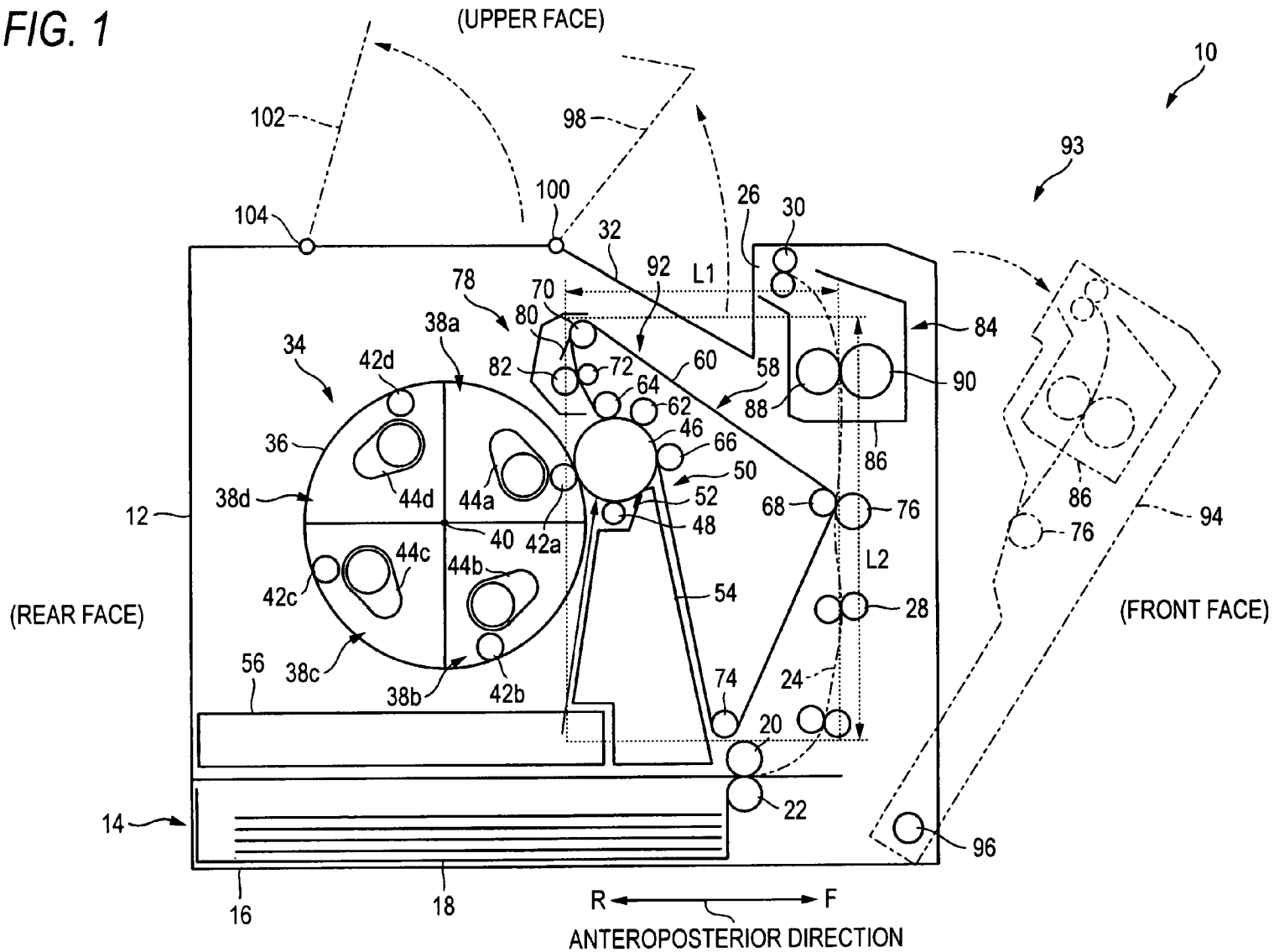
FIG. 1 is a section view of an image forming apparatus of an embodiment of the invention.

FIG. 1 shows an image forming apparatus 10 of the embodiment of the invention. The image forming apparatus 10 has an image forming apparatus body 12. A recording medium supply unit 14 of, for example, one stage is placed in a lower portion of the image forming apparatus body 12.

As shown in FIG. 1, the anteroposterior direction (the directions of the arrows F and R in FIG. 1) of the image forming apparatus 10 in the embodiment is a direction which is perpendicular to the axial direction of a photosensitive drum 46 that will be described later, and which is horizontal. Therefore, the front face of the image forming apparatus body 12 is one face which is perpendicular to the axial direction of the photosensitive drum 46, and which is formed in the horizontal direction, and the rear face of the image forming apparatus body 12 is another face which is perpendicular to the axial direction of the photosensitive drum 46, and which is formed in the horizontal direction.

The recording medium supply unit 14 has a recording medium supply unit body 16, and a recording medium supply cassette 18 in which recording media (sheets) are accommodated. The recording medium supply cassette 18 is slidably attached to the recording medium supply unit body 16, and can be drawn out in the front-face direction (the rightward direction in FIG. 1). In the image forming apparatus 10, sheets are replenished by the user from the front face side of the image forming apparatus body 12. Above the vicinity of the front end of the recording medium supply cassette 18, a feed roll 20 which supplies recording media from the recording medium supply cassette 18, and a retard roll 22 which separates the supplied recording media one by one are placed.

A transport path 24 is a recording-medium passage which elongates from the feed roll 20 to a discharge port 26, and formed on the front face side (the right side face in FIG. 1) of the image forming apparatus body 12 so as to elongate substantially vertically from the recording medium supply unit 14 to a fixing device 84 which will be described later. In the transport path 24, a secondary transfer roll 76 and a secondary transfer backup roll 68 which will be described later are placed on the upstream side of the fixing device 84, and registration rolls 28 are placed on the upstream side of the secondary transfer roll 76 and the secondary transfer backup roll 68. A discharge roll 30 is placed in the vicinity of the discharge port 26 of the transport path 24.

Therefore, the recording media which are fed from the recording medium supply cassette 18 of the recording medium supply unit 14 by the feed roll 20 are separated one by one by the retard roll 22, and only the uppermost recording medium is guided into the transport path 24 and temporarily stopped by the registration rolls 28. At an adequate timing, the recording medium is passed between the secondary transfer roll 76 and the secondary transfer backup roll 68 which will be described later, so that a toner image is transferred onto the medium. The transferred toner image is fixed by the fixing device 84. Then, the recording medium is discharged by the discharge roll 30 from the discharge port 26 to a discharge section 32 which is disposed in an upper portion of the image forming apparatus body 12. The discharge section 32 is inclined so that the portion of the discharge port is lowest and the discharge section is gradually raised as further advancing toward the back face (the leftward direction in FIG. 1).

In the image forming apparatus body 12, a rotary developing device 34 is placed on the side opposite to the intermediate transfer belt (described later) across the photosensitive drum 46 which will be described later. In the developing device body 36, the rotary developing device 34 has developing devices 38*a* to 38*d* which form respective toner images of four colors or yellow, magenta, cyan, and black, and rotates in the left-hand direction (a counterclockwise direction in FIG. 1) with using the center 40 of the rotary developing device as a center. The developing devices 38*a* to 38*d* have developing rolls 42*a* to 42*d*, respectively, and are pressed in the direction of the normal line of the developing device body 36 by elastic members (not shown) such as coil springs. The developing devices 38*a* to 38*d* have toner cartridges 44*a* to 44*d* serving as developer housing units in which toners (developers) of the four colors or yellow, magenta, cyan, and black are loaded, respectively. The toner cartridges 44*a* to 44*d* are detachably disposed on the developing devices 38*a* to 38*d*, respectively.

The photosensitive drum 46 serving as a photosensitive member is placed so as to butt against the rotary developing device 34. In a state where the developing rolls 42*a* to 42*d* do not butt against the photosensitive drum 46, a part of the outer periphery of each of the developing rolls radially protrudes by, for example, 2 mm from the outer periphery of the developing device body 36. At the both ends of the developing rolls 42*a* to 42*d*, tracking rolls (not shown) having a diameter which is slightly larger than the diameters of the developing rolls 42*a* to 42*d* are disposed so as to rotate coaxially with the developing rolls 42*a* to 42*d*. Namely, the tracking rolls of the developing rolls 42*a* to 42*d* butt against flanges (not shown) disposed at the both ends of the photosensitive drum 46, and predetermined gaps are formed between the developing rolls 42*a* to 42*d* and the photosensitive drum 46, so that latent images on the photosensitive drum 46 are developed with toners of the respective colors.

A charging device 48 which uniformly charges the photosensitive drum 46, and which is formed by, for example, a charging roll is disposed below the photosensitive drum 46. A photosensitive drum cleaner 50 butts against the photosensitive drum 46 on the upstream side of the charging device 48 in the rotation direction of the photosensitive drum 46. The photosensitive drum cleaner 50 is configured by, for example, a cleaning blade 52 which scrapes off a toner remaining on the photosensitive drum 46 after the primary transfer, and a toner recovery bottle 54 which recovers the toner scraped by the cleaning blade 52.

An exposing device 56 which, by means of a light beam such as a laser beam, writes a latent image on the photosensitive drum 46 charged by the charging device 48 is placed below the rotary developing device 34. An intermediate transfer device 58 onto which toner images which have been formed as visible images by the rotary developing device 34 are primary-transferred, and which transports the toner images to a secondary transfer position described later is disposed in the front direction (the rightward direction in FIG. 1) with respect to the rotary developing device 34.

The intermediate transfer device 58 is configured by: an intermediate transfer belt 60, a primary transfer roll 62, a wrap-in roll 64, a wrap-out roll 66, a secondary transfer backup roll 68, a scraper backup roll 70, a brush backup roll 72, and a support roll 74. The intermediate transfer belt 60 has a primary transfer station (photosensitive drum wrap area) which butts against the photosensitive drum 46 in a wrapping manner between the wrap-in roll 64 which is placed above the rear face side (the left side face in FIG. 1) of the intermediate transfer belt 60 and upstream from the primary transfer roll 62, and the wrap-out roll 66 disposed downstream from the primary transfer roll 62. The intermediate transfer belt is wound around only a predetermined range of the photosensitive drum 46, and follows the rotation of the photosensitive drum 46. In this way, toner images on the photosensitive drum 46 are overlappingly primary-transferred onto the intermediate transfer belt 60 by the primary transfer roll 62, in the sequence of, for example, yellow, magenta, cyan, and black. The intermediate transfer belt transports the primary-transferred toner images to the secondary transfer roll 76 which will be described later.

On the front face side (the right side face in FIG. 1) of the intermediate transfer belt 60, a projecting portion is formed by the secondary transfer backup roll 68. The projecting portion constitutes as a secondary transfer station to be opposed to the transport path 24. According to the configuration, the distance (a predetermined distance on the belt) between a primary transfer position and the secondary transfer position which will be described later is ensured.

The scraper backup roll 70 assists a scraper 80 which will be described later to scrape off a toner which remains on the intermediate transfer belt 60 after the secondary transfer. The brush backup roll 72 assists a brush roll 82 which will be described later to scrape off a toner which remains on the intermediate transfer belt 60 after the secondary transfer.

The secondary transfer roll 76 is opposed across the transport path 24 to the secondary transfer backup roll 68 of the intermediate transfer device 58. Namely, the space between the secondary transfer roll 76 and the secondary transfer backup roll 68 is configured as the secondary transfer position of the secondary transfer station. While being assisted by the secondary transfer backup roll 68, the secondary transfer roll 76 secondary-transfers the toner images which have been primary-transferred onto the intermediate transfer belt 60, onto the recording medium at the secondary transfer position. During a period when the intermediate transfer belt 60 rotates three times, i.e., a period when the toner images of three colors or yellow, magenta, and cyan are transported, the secondary transfer roll 76 is separated from the intermediate transfer belt 60. When the black toner image is transferred, the secondary transfer roll butts against the intermediate transfer belt 60.

An intermediate-transfer belt cleaner 78 is disposed so as to butt against an upper end portion of the intermediate transfer belt 60. The intermediate-transfer belt cleaner 78 is, for example, configured by: the scraper 80 which scrapes off a toner remaining on the intermediate transfer belt 60 after the secondary transfer, thereby cleaning the belt; a brush roll 82 which further scrapes off a toner that remains even after the cleaning process by the scraper 80; and a toner recovery bottle (not shown) which recovers the toner scraped by the scraper 80 and brush roll 82. The scraper 80 is formed by, for example, a thin plate of stainless steel, and a voltage which is opposite in polarity to the toner is applied to the scraper. During a period when the intermediate transfer belt 60 transports the toner images in order to perform color overlapping, the scraper 80 and the brush roll 82 are separated from the intermediate transfer belt 60, and, at a predetermined timing, they are integrated into one unit to butt against the intermediate transfer belt 60.

The fixing device 84 is placed above the secondary transfer position. The fixing device 84 has a fixing device body 86 in which a heating roll 88 and a pressurizing roll 90 are disposed. The heating roll 88 and the pressurizing roll 90 fix the toner image which has been secondary-transferred onto the recording medium by the secondary transfer roll 76 and the secondary transfer backup roll 68, onto the recording medium with heat and pressure, and then transport the recording medium toward the discharge roll 30.

An image forming unit 92 is an integration of the intermediate transfer device 58, the photosensitive drum 46, the charging device 48, the photosensitive drum cleaner 50, and the intermediate-transfer belt cleaner 78. The image forming unit 92 is placed immediately below the discharge section 32, and disposed detachably with respect to the image forming apparatus body 12.

The intermediate transfer belt 60 is placed so that the distance between the ends in the height direction of the image forming apparatus body 12 is longer than that between the ends in the anteroposterior direction of the image forming apparatus body 12. As shown in FIG. 1, namely, the vertical maximum dimension L2 in which the intermediate transfer belt 60 is placed (in the embodiment, for example, the distance between the scraper backup roll 70 shown in FIG. 1 and the support roll 74) is longer than the horizontal maximum dimension L1 (in the embodiment, for example, the distance between the secondary transfer backup roll 68 shown in FIG. 1 and the scraper backup roll 70) (i.e., L2>L1). While the intermediate transfer belt 60 is ensured to have a predetermined length, i.e., the length of the intermediate transfer belt 60 is not shortened, therefore, the anteroposterior size (length) of the image forming apparatus body 12 is shortened.

Furthermore, at least a part of the photosensitive drum 46 (in the embodiment, the whole of the photosensitive drum 46) is placed within the distance between the anteroposterior ends of the intermediate transfer belt 60, i.e., the horizontal maximum dimension L1 (shown in FIG. 1) in which the intermediate transfer belt 60 is placed. At least apart of the registration rolls 28 (in the embodiment, a portion corresponding to one of the registration rolls 28) is placed within the distance between the anteroposterior ends of the intermediate transfer belt 60, i.e., the horizontal maximum dimension L1 (shown in FIG. 1) in which the intermediate transfer belt 60 is placed. In other words, the photosensitive drum 46 and the registration rolls 28 are placed so that at least a part thereof is within the projected dimension of the intermediate transfer belt 60 when the intermediate transfer belt 60 is seen from the upper side of the image forming apparatus body 12. According to the configuration, a space for placing the registration rolls 28 is not required to be additionally disposed outside the space between the anteroposterior ends of the intermediate transfer belt 60 in the image forming apparatus body 12, and hence the anteroposterior size (length) of the image forming apparatus body 12 is further shortened.

The registration rolls 28 are placed between the lowest end (the position where the support roll 74 is placed) of the intermediate transfer belt 60 and the secondary transfer roll 76. Therefore, a space for placing the registration rolls 28 is not required to be additionally disposed outside the space between the ends in the height direction of the intermediate transfer belt 60 in the image forming apparatus body 12, and hence increase of the size of the image forming apparatus body 12 in the height direction is suppressed.

In the image forming apparatus body 12, an openable and closable cover 93 serving as openable and closable means which can be opened and closed from the front face side of the image forming apparatus body 12 is disposed. The openable and closable cover 93 has a first openable and closable cover 94 serving as a first lid, a second openable and closable cover 98 serving as a second lid, and a third openable and closable cover 102 serving as a third lid.

The first openable and closable cover 94 is disposed in the front face of the image forming apparatus body 12 so as to be swingable about a first swing fulcrum 96. When the first openable and closable cover 94 is opened, the secondary transfer roll 76 and the fixing device 84 are moved together with the first openable and closable cover 94 toward the front face (the right side face in FIG. 1) of the image forming apparatus body 12. Therefore, the nip between the secondary transfer backup roll 68 and the secondary transfer roll 76 is canceled by opening the first openable and closable cover 94.

In an upper portion of the image forming apparatus body 12, the second openable and closable cover 98 which can be opened and closed from the front face side of the image forming apparatus body 12 is disposed so as to be swingable about a second swing fulcrum 100. In the rear (the leftward direction in FIG. 1) of the second openable and closable cover 98 in the upper portion of the image forming apparatus body 12, the third openable and closable cover 102 which can be opened and closed from the front face side of the image forming apparatus body 12 is disposed so as to be swingable about a third swing fulcrum 104.

In the above configuration, when an image formation signal is sent, the photosensitive drum 46 is uniformly charged by the charging device 48, and a light beam is emitted based on an image signal by the exposing device 56 to the charged photosensitive drum 46. The light beam from the exposing device 56 exposes the surface of the photosensitive drum 46 to form a latent image. Latent images on the photosensitive drum 46 which have been formed by the exposing device 56 are developed by the rotary developing device 34 as toner images of yellow, magenta, cyan, and black. The toner images are overlappingly primary-transferred onto the intermediate transfer belt 60. After the primary transfer, a waste toner which remains on the photosensitive drum 46 is scraped off and recovered by the photosensitive drum cleaner 50.

On the other hand, in response to a recording medium supply signal or the like, a recording medium housed in the recording medium supply cassette 18 is fed out by the feed roll 20, separated from another recording medium by the retard roll 22 to be guided into the transport path 24, and temporarily stopped by the registration rolls 28. At an adequate timing, the recording medium is guided between the secondary transfer roll 76 and the secondary transfer backup roll 68. When the recording medium is guided between the secondary transfer roll 76 and the secondary transfer backup roll 68, the toner images which have been primary-transferred onto the intermediate transfer belt 60 are secondary-transferred onto the recording medium by the secondary transfer roll 76 and the secondary transfer backup roll 68. After the secondary transfer, a waste toner which remains on the intermediate transfer belt 60 is scraped off and recovered by the intermediate-transfer belt cleaner 78.

The recording medium onto which the toner images have been transferred is guided to the fixing device 84. In the fixing device 84, the toner images are fixed with heat and pressure to the recording medium by the heating roll 88 and the pressurizing roll 90. The recording medium to which the toner images are fixed is discharged to the discharge section 32 via the discharge roll 30.

Next, a method of replacing (attaching or detaching) the image forming unit 92, that of replacing (attaching or detaching) the toner cartridges 44*a* to 44*d*, and a jam process will be described with reference to FIGS. 2A to 4B.

Figure 2A:
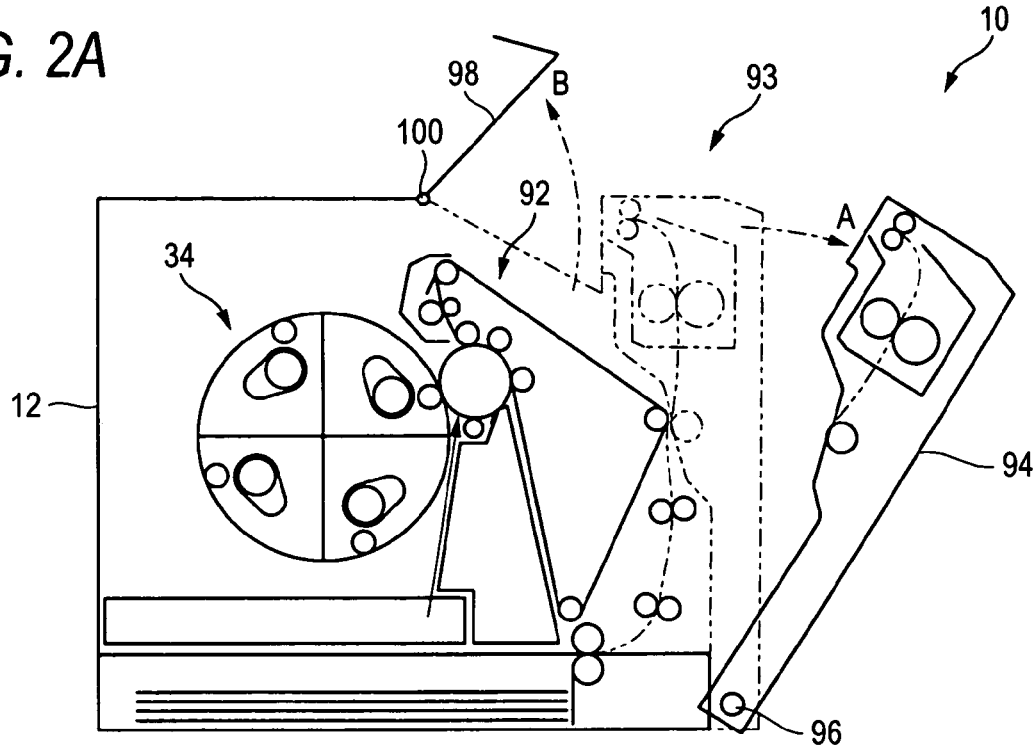
Figure 2B:
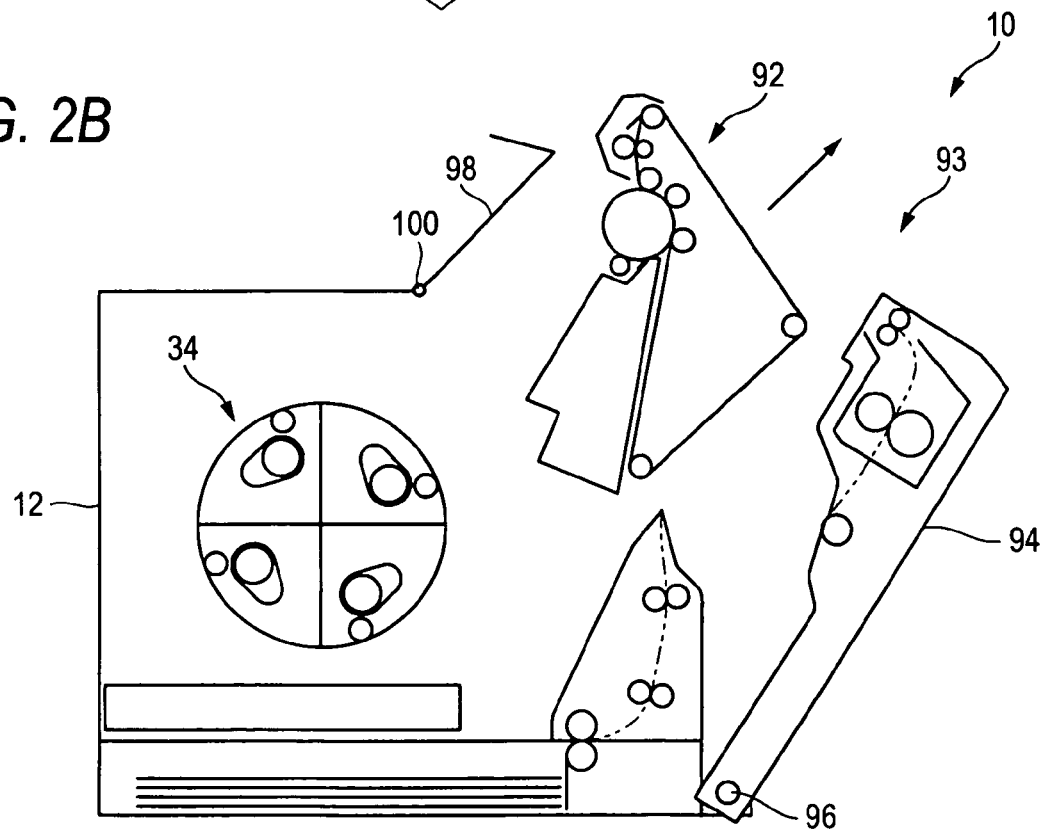

FIGS. 2A and 2B show the method of replacing (attaching or detaching) the image forming unit 92.

As shown in FIG. 2A, first, the user swings and opens the first openable and closable cover 94 about the first swing fulcrum 96 in the front-face direction (the direction of the arrow A in FIG. 2A of the image forming apparatus body 12, from the front face side (the right side face in FIG. 2A) of the image forming apparatus body 12. Furthermore, the user swings and opens the second openable and closable cover 98 about the second swing fulcrum 100 in the upward direction (the direction of the arrow B in FIG. 2A) of the image forming apparatus body 12.

As shown in FIG. 2B, then, the image forming unit 92 is replaced (attached or detached) through an opened portion which is formed as a result of opening the first and second openable and closable covers 94 and 98.

Figure 3C:
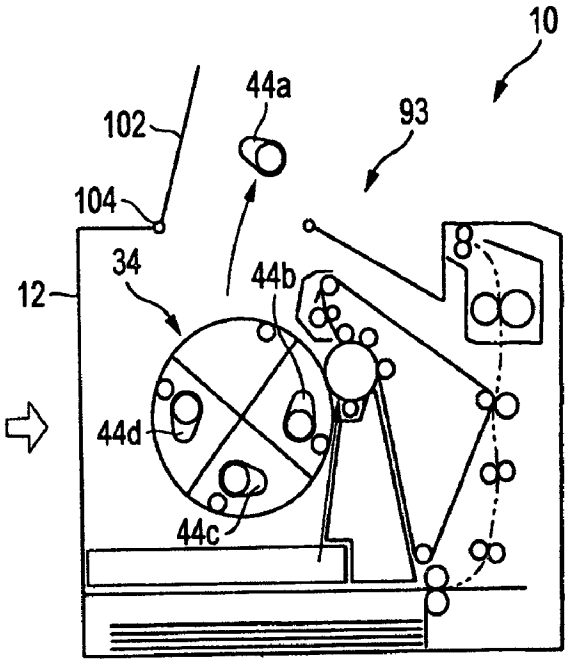
FIG. 3C is a side view showing a state where the image forming unit is detached.
Figure 3B:
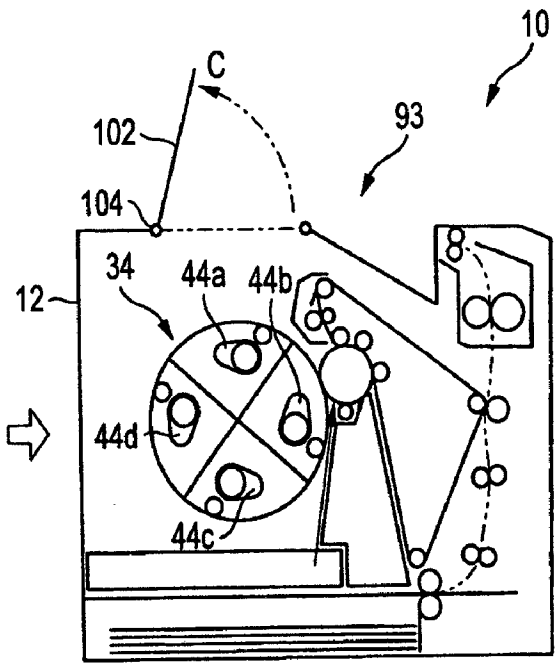
Figure 3A:
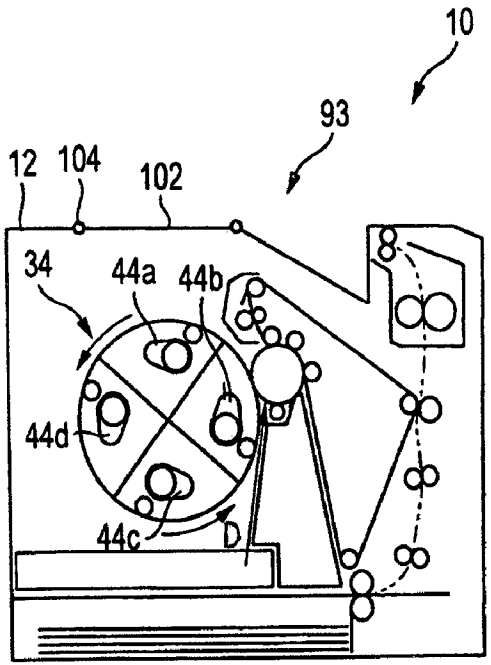

FIGS. 3A-3C show the method of replacing (attaching or detaching) the toner cartridges 44*a* to 44*d*.

As shown in FIG. 3A, first, the rotary developing device 34 is rotated (for example, in the direction of the arrow D shown in FIG. 3A) so that one of the toner cartridges 44*a* to 44*d* which is to be replaced (attached or detached) (in the embodiment, the toner cartridge 44*a*) is positioned in the upper side of the image forming apparatus body 12. Specifically, the user operates an operation lever (not shown) disposed on the image forming apparatus body 12, whereby the rotary developing device 34 is automatically rotated so that the toner cartridge to be replaced (attached or detached) (in the embodiment, the toner cartridge 44*a*) is positioned in the upper side of the image forming apparatus body 12.

As shown in FIG. 3B, next, the user swings and opens the third openable and closable cover 102 about the third swing fulcrum 104 in the upward direction (the direction of the arrow C in FIG. 3B) of the image forming apparatus body 12, from the front face side (the right side face in FIG. 3B) of the image forming apparatus body 12. As shown in FIG. 3C, then, one of the toner cartridges 44*a* to 44*d* (in the embodiment, the toner cartridge 44*a*) is replaced (attached or detached) through an opened portion which is formed as a result of opening the third openable and closable cover 102.

Figure 4A:
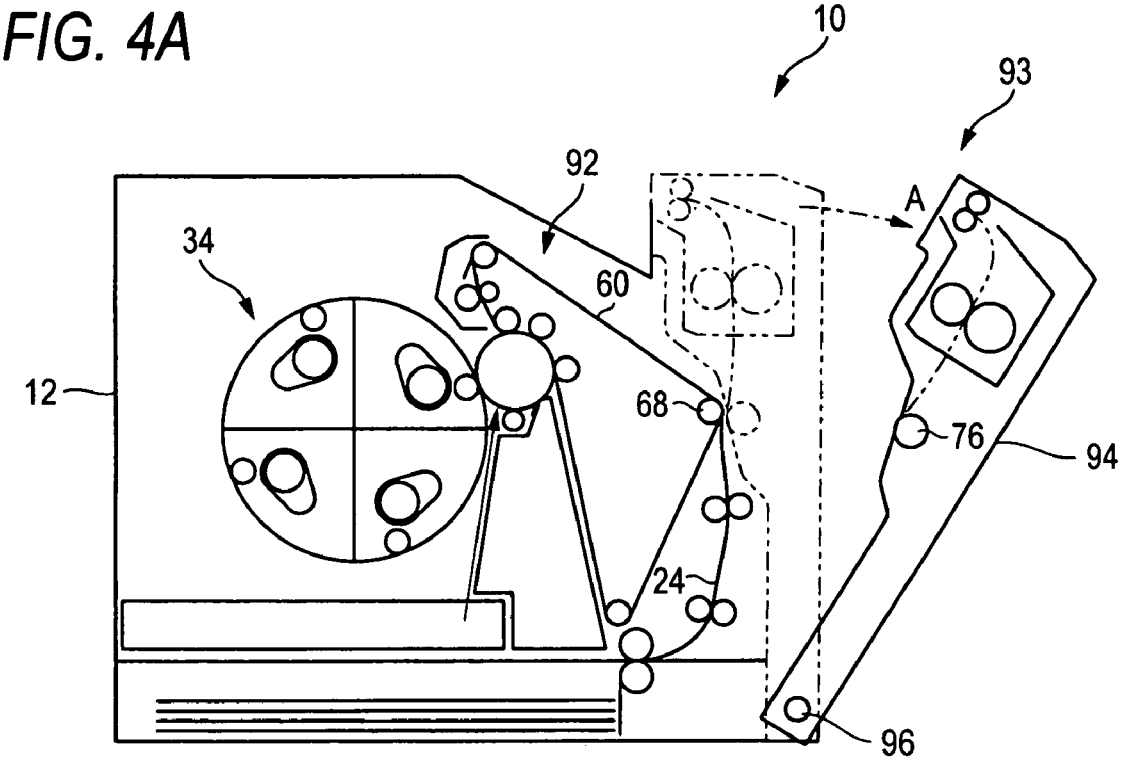
Figure 4B:
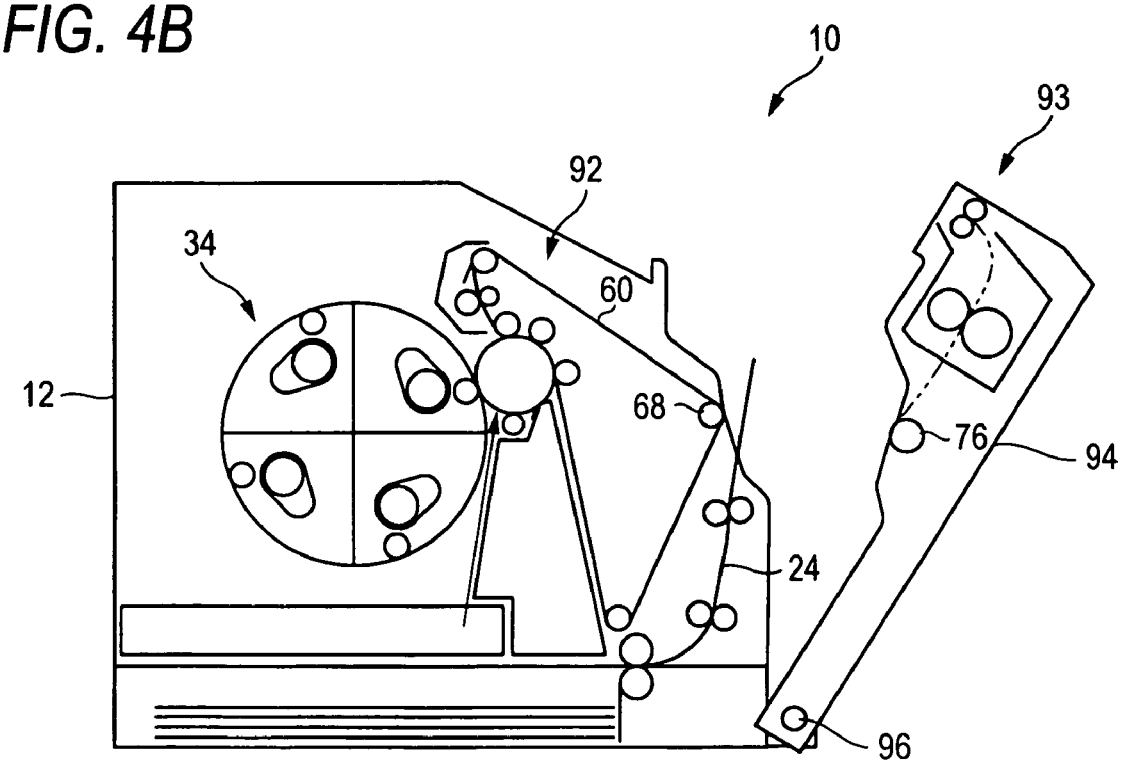

FIGS. 4A and 4B show a method of processing a jam.

When a jam occurs, as shown in FIG. 4A, the user swings and opens the first openable and closable cover 94 about the first swing fulcrum 96 in the front-face direction (the direction of the arrow A in FIG. 4A) of the image forming apparatus body 12, from the front face side (the right side face in FIG. 4A) of the image forming apparatus body 12. When the first openable and closable cover 94 is opened, the nip portion between the secondary transfer backup roll 68 and the secondary transfer roll 76 is canceled. As shown in FIG. 4B, then, the recording medium which is in the transport path 24, and which has caused the jam is removed through an opened portion which is formed as a result of opening the first openable and closable cover 94.

As described above, the intermediate transfer belt 60 is disposed so that the distance between the ends in the height direction of the image forming apparatus body 12 is longer than that between the ends in the anteroposterior direction, at least a part of the photosensitive drum 46 is placed within between the anteroposterior ends of the intermediate transfer belt 60, and the openable and closable cover 93 is disposed in the image forming apparatus body 12 so as to allow attachment and detachment of the toner cartridges 44*a* to 44*d* to be performed from the upper face side or the front face side. Therefore, the anteroposterior size (length) of the image forming apparatus body 12 is shortened, and attachment and detachment of the toner cartridges 44*a* to 44*d* can be performed from the upper face side (in a state where the user is on the front face side of the image forming apparatus body 12), whereby the operability is improved.

Furthermore, the openable and closable cover 93 is configured so as to have the three openable and closable covers or the first openable and closable cover 94, the second openable and closable cover 98, and the third openable and closable cover 102. In addition to attachment and detachment of the toner cartridges 44*a* to 44*d*, therefore, attachment and detachment of the image forming unit 92 and the jam process are enabled from the front face side, whereby the operability is further improved.

As described above, the recording medium supply cassette 18 is configured so as to be slidably attached to the recording medium supply unit body 16, and to be drawn out in the front-face direction (the rightward direction in FIG. 1). Therefore, sheets can be replenished from the front face side.

The image forming apparatus of the invention is laid out so that all user operations such as attachment and detachment of the toner cartridge, a jam process, and replenishment of sheets can be performed only from an upper face side or a front face side. Therefore, the operability is improved.

Furthermore, the apparatus is configured so that the distance (a predetermined distance on the belt) between the primary transfer position and the secondary transfer position is ensured. Therefore, transmission in which a shock occurring when a thick board passes the secondary transfer position is transmitted to the primary transfer position can be mitigated. In the configuration where the intermediate transfer belt 60 butts against the photosensitive drum 46 in a wrapping manner, even when a shock due to passage of a thick board is transmitted from the secondary transfer station, the stability of nipping in the primary transfer station can be held.

What is claimed is:

1. An image forming apparatus comprising:

an image forming apparatus body;

a photosensitive member disposed in the image forming apparatus body;

an intermediate transfer belt disposed in the image forming apparatus body, the intermediate transfer belt onto which a toner image on the photosensitive member is to be transferred; and a developing device disposed in the image forming apparatus body, the developing device placed on a side opposite to the intermediate transfer belt across the photosensitive member and provided with a detachable toner cartridge;

wherein the intermediate transfer belt is disposed such that a distance between ends in a height direction of the image forming apparatus body is longer than a distance between ends in an anteroposterior direction of the image forming apparatus body;

at least a part of the photosensitive member is placed between the anteroposterior ends of the intermediate transfer belt; and the image forming apparatus body includes at least one openable section at an upper face side or a front face side thereof to allow the toner cartridge to be attached and detached therethrough and to allow a jam to be fixed therethrough, wherein the at least one openable section includes first, second, and third lids, wherein the first lid has a first rotation axis, about which the first lid rotates, provided on the front face side of the image forming apparatus body, wherein a fixing device is attached to the first lid such that the fixing device is integrally moved with the first lid when the first lid is opened and closed, wherein the second lid has a second rotation axis, about which the second lid rotates, provided on the upper face side of the image forming apparatus body, wherein the third lid has a third rotation axis, about which the third lid rotates, provided on the upper face side of the image forming apparatus body, wherein the third rotation axis is provided further away from the front surface side of the image forming apparatus body than the second rotation axis, and wherein the toner cartridge is attachable and detachable through an opening created when the third lid is open.

2. The image forming apparatus according to claim 1, further comprising a registration roller disposed in the image forming apparatus body, for transporting a recording medium at a predetermined timing;

wherein at least a part of the registration roller is placed between the anteroposterior ends of the intermediate transfer belt.

3. The image forming apparatus according to claim 2, further comprising a secondary transfer roller disposed in the image forming apparatus body, for transferring a toner image on the intermediate transfer belt onto the recording medium;

wherein the registration roller is placed between a lowermost end of the intermediate transfer belt and the secondary transfer roll.

4. The image forming apparatus according to claim 1, wherein the at least one openable section includes first, second, and third lids;

the jam is fixable when the first lid opens;

an image forming unit including the photosensitive member is attachable and detachable when the first and second lids open; and the toner cartridge is attachable and detachable when the third lid opens.

5. A method of attaching or detaching a toner cartridge comprising:

providing an image forming apparatus, wherein the image forming apparatus comprises:

an image forming apparatus body;

a photosensitive member disposed in the image forming apparatus body;

an intermediate transfer belt onto which a toner image on the photosensitive member is to be transferred, wherein the intermediate transfer belt is disposed in the image forming apparatus body;

a developing device disposed in the image forming apparatus body, wherein the developing device and the intermediate transfer belt are placed on opposite sides of the photosensitive member, and wherein the developing device is provided with a detachable toner cartridge; and a lid provided which has a rotation axis, about which the lid rotates, provided on an upper face side of the image forming apparatus body;

opening the lid; and attaching or detaching the detachable toner cartridge to the developing device through an opening created when the lid is opened, wherein the intermediate transfer belt is maintained in a printing position in which it transfers an image onto a medium when the detachable toner cartridge is attached or detached.

6. The method for attaching or detaching a toner cartridge according to claim 5, wherein the developing device is a rotary developing device in which a plurality of detachable toner cartridges rotate about an axis, the method further comprising:

rotating the rotary developing device such that the detachable toner cartridge which is to be detached is positioned at an upper portion of the rotary developing device; and detaching the detachable toner cartridge while it is positioned at the upper portion of the rotary developing device.

7. An image forming apparatus comprising:

an image forming apparatus body;

a photosensitive member disposed in the image forming apparatus body;

an intermediate transfer belt disposed in the image forming apparatus body, the intermediate transfer belt onto which a toner image on the photosensitive member is to be transferred; and a developing device disposed in the image forming apparatus body, the developing device placed on a side opposite to the intermediate transfer belt across the photosensitive member and provided with a detachable toner cartridge;

wherein the intermediate transfer belt is disposed such that a distance between ends in a height direction of the image forming apparatus body is longer than a distance between ends in an anteroposterior direction of the image forming apparatus body;

at least a part of the photosensitive member is placed between the anteroposterior ends of the intermediate transfer belt; and the image forming apparatus body includes at least one openable section at an upper face side or a front face side thereof to allow the toner cartridge to be attached and detached therethrough and to allow a jam to be fixed therethrough;

wherein the at least one openable section includes a lid that has a rotation axis, about which the lid rotates, provided at the upper face side of the image forming apparatus body, and wherein the detachable toner cartridge is attached or detached through an opening created when the lid is opened even when the intermediate transfer belt is maintained at a printing position in which it transfers an image onto a medium.

8. The image forming apparatus according to claim 7, wherein the developing device is a rotary developing device in which a plurality of detachable toner cartridges rotate about an axis, and wherein nothing is provided between the opening and at least one of the detachable toner cartridges provided with the rotary developing device so that the at least one of the toner cartridges is able to be attached and detached through the opening.

9. An image forming apparatus comprising:

an image forming apparatus body;

a photosensitive member disposed in the image forming apparatus body;

an intermediate transfer belt disposed in the image forming apparatus body, the intermediate transfer belt onto which a toner image on the photosensitive member is to be transferred; and a developing device disposed in the image forming apparatus body, the developing device placed on a side opposite to the intermediate transfer belt across the photosensitive member and provided with a detachable toner cartridge;

wherein the intermediate transfer belt is disposed such that a distance between ends in a height direction of the image forming apparatus body is longer than a distance between ends in an anteroposterior direction of the image forming apparatus body;

at least a part of the photosensitive member is placed between the anteroposterior ends of the intermediate transfer belt; and the image forming apparatus body includes at least one openable section at an upper face side or a front face side thereof to allow the toner cartridge to be attached and detached therethrough and to allow a jam to be fixed therethrough, wherein the at least one openable section includes first, second, and third lids;

the jam is fixable when the first lid opens;

an image forming unit including the photosensitive member is attachable and detachable when the first and second lids open; and the toner cartridge is attachable and detachable when the third lid opens.

* * * * *